US007905988B2

(12) United States Patent
Scherb

(10) Patent No.: US 7,905,988 B2
(45) Date of Patent: Mar. 15, 2011

(54) METHOD FOR THE PRODUCTION OF A WEB OF TISSUE MATERIAL

(75) Inventor: Thomas Thoroee Scherb, Morumbi-Sao Paolo (BR)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 12/549,085

(22) Filed: Aug. 27, 2009

(65) Prior Publication Data

US 2010/0059192 A1 Mar. 11, 2010

Related U.S. Application Data

(60) Division of application No. 10/969,946, filed on Oct. 22, 2004, now Pat. No. 7,597,778, which is a continuation of application No. PCT/EP03/50074, filed on Mar. 20, 2003.

(30) Foreign Application Priority Data

Apr. 25, 2002 (DE) ..... 102 18 509

(51) Int. Cl.
*D21F 7/06* (2006.01)

(52) U.S. Cl. ..... 162/263; 162/111; 162/123; 162/141; 242/541.4

(58) Field of Classification Search ..... 162/263, 162/123, 111, 118, 141, 142; 242/541.4, 242/541.7, 542.3
See application file for complete search history.

(56) References Cited

U.S. PATENT DOCUMENTS

| | | | |
|---|---|---|---|
| 6,027,611 | A | 2/2000 | McFarland et al. |
| 6,154,981 | A | 12/2000 | Heikkila et al. |
| 6,258,210 | B1 | 7/2001 | Takeuchi et al. |
| 6,332,952 | B1 | 12/2001 | Hsu et al. |
| 6,604,703 | B2 | 8/2003 | Beisswanger et al. |
| 2001/0052560 | A1 | 12/2001 | Beisswanger et al. |
| 2002/0104628 | A1 | 8/2002 | Watson |

FOREIGN PATENT DOCUMENTS

| | | |
|---|---|---|
| EP | 1116824 | 7/2001 |

*Primary Examiner* — Mark Halpern
(74) *Attorney, Agent, or Firm* — Greenblum & Bernstein, P.L.C.

(57) ABSTRACT

Machine, in particular a tissue machine, for production of a web of tissue material. The web of tissue material is produced by supplying at least two stock grades to a multilayer flow box, winding up the tissue web on a reel of a reel-up, and maintaining a winding nip having a line pressure of less than or equal to 0.8 kN/m to influence the hardness of the reel produced, in a machine that includes a multilayer flow box structured and arranged to supply at least two stock grades, an endless supporting belt, a drying cylinder and an opposing unit arranged to form a press nip, wherein endless supporting belt guides the web through the press nip, a reel-up for reeling up the tissue web, and a device to influence, in a predefined way, a hardness of a reel produced as the tissue web is reeled. The instant abstract is neither intended to define the invention disclosed in this specification nor intended to limit the scope of the invention in any way.

62 Claims, 8 Drawing Sheets

METHOD FOR THE PRODUCTION OF A WEB OF TISSUE MATERIAL

CROSS-REFERENCE TO RELATED APPLICATIONS

The present application is a Divisional of U.S. application Ser. No. 10/969,946 filed Oct. 22, 2004, which is a Continuation of International Patent Application No. PCT/EP03/50074 filed Mar. 20, 2003, and claims priority of German Patent Application No. 102 18 509.3 filed Apr. 25, 2002. Moreover, the disclosures of U.S. application Ser. No. 10/969,946 and of International Patent Application No. PCT/EP03/50074 are expressly incorporated by reference herein in their entireties.

BACKGROUND OF THE INVENTION

1. Field of the Invention

The present invention relates to a method for the production of a web of tissue material. This can be, in particular, such tissue grades as, for example, "toilet tissue", "facial tissue", serviette paper and/or and the like. Furthermore, the invention relates to a tissue machine for carrying out the method.

2. Discussion of Background Information

In particular in the case of the aforementioned tissue grades, what is important, inter alia, is the specific volume ("bulk", measured in [$cm^3/g$]), which should be as high as possible, and what is known as the "hand feel", which is a measure of how pleasant the tissue, for example facial tissue, feels when gripped. Since this measure depends on the subjective sense of the user, there is no objective measurement method. Characteristics such as softness, velvetiness, flat surface topography (as opposed to roughly creped and/or embossed surfaces) benefit a high measure of "hand feel". A "hand feel" value is determined as the result of the subjective assessment of a large number of test people.

Of course, a certain minimum strength, which suits the requirements of the user, is also important for such a tissue product.

A number of concepts of tissue machines have already been proposed, which generally have the object of improving the tissue characteristics.

SUMMARY OF THE INVENTION

The present invention provides an improved method and an improved tissue machine of the type mentioned at the beginning with which a tissue product or tissue paper, in particular "toilet tissue" and "facial tissue" with a particularly high "hand feel" and high specific volume (bulk) with acceptable strength is ensured. In the case of a "facial tissue" with a mass per unit area (grammage) of, for example, 15 $g/m^2$, the aim is a specific volume (bulk) of 10 $cm^3/g$ and higher, and in the case of a mass per unit area (grammage) of 23 $g/m^2$, a specific volume (bulk) of 9.0 $cm^3/g$ and higher. In addition, the relevant tissue machine should be as simple as possible in construction and economical. At the same time, as many different product grades as possible should be capable of production on this machine.

According to the invention, a method for the production of a web of tissue material by a tissue machine having a flow box and an endless supporting belt, in which the tissue web is led through a press nip formed between a drying cylinder and an opposing unit. The flow box used is a multilayer flow box, in which at least two stock grades are supplied to the multilayer flow box. The tissue web is wound up by a reel-up after the press nip, and the hardness of the reel produced preferably is influenced in a predefinable way, in particular controlled and/or regulated.

In this case, the drying cylinder used is preferably a Yankee cylinder.

The line force produced in the winding nip is expediently selected to be less than or equal to 0.8 kN/m.

According to a preferred practical configuration of the method according to the invention, use is made of a former having two circulating endless belts, which run together, forming a stock inlet gap, and are then guided over a forming element, such as in particular a forming roll, the inner belt that comes into contact with the forming element preferably forming the transport belt. Use is preferably made of a crescent former, whose inner belt is formed by a felt.

It is also particularly advantageous if the tissue web, together with the supporting belt, is led through at least one shoe press. In this case, the opposing unit assigned to the drying cylinder that is used is expediently a shoe press unit.

A high-temperature hood can be provided above the drying cylinder or Yankee cylinder.

A further improvement in the tissue product properties can also be achieved in particular by the tissue web being doctored off the drying cylinder by a creping doctor, in particular a thin creping doctor.

One or more of the following stock grades is preferably used:

fibers made of hardwood, in particular short-fiber chemical pulps fibers made of softwood, in particular long-fiber chemical pulps CTMP (chemical-thermomechanical pulp).

Preference is given to stock grade mixtures in which the proportion of fibers made of hardwood lies in a range from about 50% to about 80%, the proportion of fibers made of softwood lies in a range from about 20% to about 50% and/or the proportion of CTMP (chemical-thermomechanical pulp) lies in a range from 0% to about 20%.

Thus, amongst others, for example the following stock grade mixtures are conceivable:

| | Ex. "a" | Ex. "b" | Ex. "c" |
|---|---|---|---|
| Hardwood (50 to 80%) | 50 | 60 | 70 |
| Softwood (20 to 50%) | 30 | 40 | 20 |
| CTMP (0 to 20%) | 20 | 0 | 10 |

In this case, in particular the CTMP in a respective stock grade mixture improves the specific volume (bulk).

According to a preferred practical configuration of the method according to the invention, the tissue web is led around the drying cylinder after the press nip, the drying in the relevant wrap region preferably being intensified by a drying hood, in particular a high-temperature hood.

It is of particular advantage if the multilayer flow box is supplied with at least two different stock grades and in this case for short fibers obtained from hardwood to be used for the layer of the tissue web that faces the drying cylinder surface and for long fibers obtained from softwood to be used for the layer on the opposite side of the web.

It is also of advantage in particular if the flow box is loaded with at least two layers with different fibrous stocks, the stock with the short fibers obtained from hardwood being added into the layer of the flow box which forms the side of the tissue web that faces the drying or Yankee cylinder surface. The second layer is expediently loaded with long fibers made from softwood. Alternatively or additionally, this second layer can also be loaded with long fibers and CTMP and/or with long fibers and CMP and short fibers. This layer forms the second layer of the tissue web, which faces the drying hood in the drying process. It therefore never comes into contact with the drying or Yankee cylinder surface. Using these method steps, the "hand feel" and "bulk" values are improved by about 5% and more.

Use is preferably made of a multilayer flow box, whose nozzle is subdivided into at least two channels by at least one slat extending over the entire machine width. In this case, the nozzle is expediently subdivided at least substantially symmetrically into two channels by a slat.

Particularly good results are achieved if the slat extends outward beyond the nozzle in the region of the outlet gap. This counteracts any mixing of the plies.

Advantageously, use can be made of a flow box having dilution water regulation and/or control section by section over the machine width, in order to be able to set a respectively desired cross-machine grammage profile.

In specific cases it is advantageous if in each case dilution water regulation and/or control is provided for at least two layers. For example, when a two-layer flow box is used, in each case dilution water regulation or control can therefore be provided in both layers, if appropriate.

Dilution water regulation and/or control is preferably provided at least in the layer facing the forming or breast roll. In this case, appropriate dilution water regulation and/or control can in particular be provided only for this one layer, that is to say the outer layer with respect to the forming or breast roll. The forming or breast roll can be closed, open or else evacuated.

The drying of the web by the drying or Yankee cylinder and a drying or hot-air hood is important for the drying process, according to a preferred practical configuration of the method according to the invention, the proportion of the drying contributed by the drying hood to the drying of the tissue web is chosen to be greater than the proportion of the drying contributed by the drying cylinder.

In this case, the ratio between the proportion of the drying from the drying hood and the proportion of the drying from the drying cylinder is advantageously chosen to be greater than 55:45, in particular greater than or equal to 60:40, in particular greater than or equal to 65:35 and preferably greater than or equal to 70:30.

The drying hood is preferably operated at a temperature which is greater than or equal to 400° C., in particular greater than or equal to 500° C., in particular greater than or equal to 600° C. and preferably greater than or equal to 700° C.

The steam pressure in the drying cylinder can additionally be reduced. For example, for the steam pressure in the drying cylinder, a value is advantageously chosen which is less than or equal to 0.7 MPa, in particular less than or equal to 0.6 MPa and preferably less than or equal to 0.5 MPa.

As a result, the course of the drying can be raised further. By the aforementioned measures, an increase in the "bulk" value by up to 5% and an improvement in the "hand feel" value are achieved.

Particular importance is also attached to winding up the tissue web at the end of the tissue machine.

According to a preferred practical configuration of the method according to the invention, a reel-up is used in which the tissue web is led over a carrier drum and is then wound up onto a spool, in each case a drive preferably is assigned both to the carrier drum and to the spool. As a result, optimum reeling of the web is achieved, without destroying the specific volume (bulk) of the paper web produced. Thus, with the use of two drives for the carrier drum and the spool or the reel, in particular a reduction of the line force produced in the winding nip is possible.

According to an expedient practical configuration of the method according to the invention, the line force produced in the winding nip between the carrier drum and the spool is chosen to be less than or equal to 0.8 kN/m, in particular less than or equal to 0.5 kN/m and preferably less than or equal to 0.2 kN/m. Since no drive power has to be transmitted between the carrier drum and the reel, the pressure in the winding nip or contact nip can be reduced.

Since tissue paper is creped, exhibits high stretch, that is to say a high modulus of elasticity, and has a low tensile strength, no substantial web tension can be applied in order to increase the winding hardness of the reel.

The maximum difference between the circumferential speed of the reel and the circumferential speed of the carrier roll is preferably less than 10% of the circumferential speed of the carrier roll.

According to a preferred practical configuration of the method according to the invention, the web tension between the drying cylinder and the carrier drum is set, in particular controlled and/or regulated, to a predefinable desired value via the drive assigned to the carrier drum, independently of the line force produced in the winding nip.

On account of the creping at the creping doctor, the carrier drum circumferential speed is lower than the circumferential speed of the drying cylinder.

The drive assigned to the spool is advantageously controlled and/or regulated as a function of the speed of the carrier drum.

Of particular importance during the production of a soft reel is the control of the "low" line force in the winding nip or contact nip. According to a preferred practical configuration of the method according to the invention, a reel-up is used for this purpose in which the carrier drum is mounted in a fixed position and the spool can be moved. Accordingly, the growth in the reel diameter can be compensated for by appropriate movement of the spool. In addition, the line force in the winding nip can be set in the desired manner via the movable spool. In order to compensate for the growth in diameter of the reel and in order to set the line force in the winding nip, a common control loop can advantageously be used. One expedient configuration of the method according to the invention is distinguished by the fact that the line force in the winding nip is determined via at least one force sensor and this line force is regulated by appropriate movement of the spool. In principle, however, for example the spool can also be fixed in position and the carrier drum can be movable. Furthermore, such designs in which both the carrier drum and the spool can respectively be moved are also conceivable.

It is possible that the measurement accuracy of the sensors and the setting accuracy (friction) is no longer sufficient at low line forces and with large, heavy reels. In particular in the case of line forces in the winding nip which are less than or equal to 0.5 kN/m and in particular less than or equal to 0.2 kN/m, the movable spool is therefore preferably moved away under control. In this case, the measured variables used for the movement away under control can in particular be the reel diameter and the position of the spool or the reel formed thereon relative to the carrier drum.

According to a further advantageous configuration of the method according to the invention, in order to set, control and/or regulate the line force in the winding nip, the region of the winding nip can be monitored appropriately by a CCD camera. In this case, by the CCD camera, preferably the respective distance between the carrier drum and the spool or the reel formed on the latter is registered. With such observation of the winding nip region, for example by a CCD camera, the result is therefore a further possibility of monitoring and setting the winding force. It is therefore possible to measure and display the distance between the carrier drum and the reel. By using an evaluation of the image, it is then again possible to reach a desired value of the hydraulic cylinder pressure that influences the movable reel and, via a control device, to execute the displacement or shift as far as the desired distance or winding force. The gain in bulk can lie, for example, in a range from 4 to 8%. A further advantage is that the "bulk" gain achieved by the shoe press is not destroyed, and therefore the quality of the web is maintained.

It is also of advantage if the drive assigned to the spool and therefore to the reel is not changed during the winding operation, that is to say in particular not when the new spool is moved beyond the primary or winding start position, in which the drive is coupled up and the spool is accelerated, to the secondary position on the rails. Controlled winding from start to end therefore results.

The paper quality can be increased further by the mass per unit area of the tissue web in the uncreped state lying in a range from about 11 g/m$^2$ to about 20 g/m$^2$ and in the creped state lying in a range from about 14 g/m$^2$ to about 24 g/m$^2$.

Since, above all in the case of thin papers and in particular in the case of "facial tissue" and "toilet" tissue, the formation, that is to say uniformity of the fiber arrangement, plays an important role, the use of a crescent former is of particular advantage in these cases in particular. In this case, the web is dewatered, transported, pressed and passed on to the drying cylinder or Yankee cylinder on a felt. At the start of dewatering, an outer wire is still provided. In addition to improved formation, the result is also improved strength with possible MD/CMD breaking length ratios of 1:1 to 4:1. This makes it possible to beat the fibers less. This increases the "bulk" value. By this former type, "strength" can be converted into "bulk". This former type improves the specific volume (bulk) by +5% in combination with at least one of the design variants described.

In this case, use can be made in particular of a crescent former, whose inner or supporting belt, formed by a felt, together with the tissue web, is led over at least one evacuated device in the web running direction before the press nip. The evacuated device provided can be, in particular, a suction roll. As already mentioned, the outer belt provided in the region of the forming element of the crescent former can be formed in particular by a mesh belt (wire).

Also of particular advantage, in particular, is the use of a shoe press with a shoe length as measured in the web running direction of greater than or equal to 80 mm and preferably greater than or equal to 120 mm. By the shoe press, a line force which lies the range from 60 kN/m to about 90 kN/m is preferably produced. The maximum pressing pressure in the press nip of the shoe press is preferably less than or equal to 2 bar and preferably less than or equal to 1.5 bar. Moreover, the shoe press can comprise a shoe press unit with a blind-drilled press cover. As compared with a suction press roll, a bulk gain in a range from about 15% to about 20% can therefore be achieved.

According to an expedient practical configuration of the method according to the invention, use is made of a drying cylinder or Yankee cylinder provided with reinforcing ribs in the interior, by which the line force produced in the press nip can also be increased substantially above 90 kN/m. This makes the tissue machine more flexible, in particular for the case in which, in addition to the "facial" and "toilet" tissue papers, tissue grades are also run in which the "hand feel" and the specific volume (bulk) do not have the first priority but rather the dryness, that is to say the production level.

As already mentioned, a relatively thin creping doctor is preferably used. In this case, the thickness of the creping doctor can in particular be less than or equal to 0.9 mm.

The angle of attack between the tangent to the drying cylinder and the creping doctor is preferably less than or equal to 20°.

In the case of this creping doctor, what is known as the "rake angle" can be in particular greater than or equal to 15°.

According to the invention, a machine for the production of a web of tissue material includes a flow box and an endless supporting belt, in which the tissue web is led through a press nip formed between a drying cylinder and an opposing unit. A reel-up for subsequently reeling up the tissue web is included, and the flow box is a multilayer flow box, in which at least two stock grades can be supplied. A device is preferably provided in order to influence in a predefined way the hardness of the reel produced as the tissue web is reeled up, in particular to control and/or regulate it.

The present invention is directed to a method for production of a web of tissue material that includes supplying at least two stock grades to a multilayer flow box, winding up the tissue web on a reel of a reel-up, and influencing the hardness of the reel produced in a predefinable way.

According to a feature of the invention, the influencing can include at least one of controlling and regulating the reel hardness.

In accordance with another feature of the invention, the web can be produced in a tissue machine composed of a multilayer flow box, an endless supporting belt, and a drying cylinder and an opposing unit arranged to form a press nip. The method can further include guiding the tissue web through the press nip. The reel-up may be positioned after the press nip.

According to the present invention, the drying cylinder may be a Yankee cylinder.

Further, the reel-up can include the reel and a carrier drum arranged to form a winding nip, and the method can further include selecting a line force in the winding nip less than or equal to 0.8 kN/m.

The method can also include forming the web on a former having two circulating endless belts, which run together, forming a stock inlet gap, and then over a forming element, such that the inner belt that comes into contact with the forming element. The forming element can be a forming roll and the inner belt may be a transport belt.

The method can also include forming the web on a crescent former having an inner belt formed by a felt.

Moreover, the method can include supporting the tissue web on a supporting belt and guiding the supported web through at least one shoe press. A shoe press unit can be assigned to a drying cylinder to form a press nip, and the web may be guided through the press nip.

According to still another feature of the present invention, the method can include doctoring the tissue web off of the drying cylinder with a creping doctor. The creping doctor can be a thin creping doctor.

In accordance with a further feature of the invention, the at least two stock grades can include at least one of the following stock grades: fibers made of hardwood, in particular short-fiber chemical pulps; fibers made of softwood, in particular long-fiber chemical pulps; and CTMP (chemical-thermomechanical pulp).

According to the instant invention, the at least two stock grades may include a stock grade mixture in which a proportion of fibers made of hardwood lies in a range from about 50% to about 80%. Further, the at least two stock grades can include a stock grade mixture in which the proportion of fibers made of softwood lies in a range from about 20% to about 50%. The at least two stock grades may include a stock grade mixture in which a proportion of chemical-thermomechanical pulp (CTMP) lies in a range from 0% to about 20%.

Moreover, the method can include drying the tissue web on a drying cylinder located after a press nip. In this regard, drying in a relevant wrap region can be intensified by a drying hood.

Still further, the at least two different stock grades can include comprise short fibers obtained from hardwood, which are used for a layer of the tissue web to face a drying cylinder surface and long fibers obtained from softwood, which are used for a layer on an opposite side of the web. Chemical-thermomechanical pulp (CTMP) may additionally be used for the layer provided on the opposite side of the web. The layer on the opposite side of the web can further include short fibers.

According to still another feature of the present invention, the multilayer flow box can include a nozzle subdivided into at least two channels by at least one slat extending over an entire machine width. Further, the nozzle may be subdivided at least substantially symmetrically into two channels by the slat. The slat can extend outward beyond the nozzle in a region of an outlet gap.

The multilayer flow box can include at least one of dilution water regulation and section by section control over a machine width. The at least one of dilution water regulation and section by section control over the machine width can be provided for the at least two layers. The dilution water regulation and the control may be provided at least for a layer of the web arranged to face a forming roll.

The web may be dried on a drying cylinder under a drying hood, and a proportion of the drying contributed by the drying hood can be greater than a proportion of the drying contributed by the drying cylinder. A ratio between the proportion of the drying from the drying hood and the proportion of the drying from the drying cylinder can be greater than 55:45, may be greater than or equal to 60:40, is preferably greater than or equal to 65:35, and most preferably greater than or equal to 70:30. Further, the drying hood can be operated at a temperature greater than or equal to 400° C., may be greater than or equal to 500° C., is preferably greater than or equal to 600° C., and most preferably greater or equal to 700° C. Still further, a steam pressure in the drying cylinder may be less than or equal to 0.7 MPa, is preferably less than or equal to 0.6 MPa, and most preferably less than or equal to 0.5 MPa.

In accordance with the instant invention, at the reel-up, the method can include guiding the tissue web over a carrier drum and winding the web onto a spool. A drive may be provided to both the carrier drum and the spool. The carrier drum and spool may be arranged to form a winding nip, and a line force produced in the winding nip can be less than or equal to 0.8 kN/m, preferably less than or equal to 0.5 kN/m, and most preferably less than or equal to 0.2 kN/m. Further, a maximum difference between a circumferential speed of the reel and a circumferential speed of the carrier drum can be less than 10% of the circumferential speed of the carrier drum. A web tension between a drying cylinder and the carrier drum can be set to a predefinable desired value via the drive assigned to the carrier drum, independently of the line force produced in the winding nip. Moreover, the web tension can at least one of controlled and regulated. The drive assigned to the spool can be at least one of controlled and regulated as a function of the speed of the carrier drum. Also, the carrier drum can be mounted in a fixed position and the spool is movable, such that growth in a reel diameter is compensated by appropriate movement of the spool. Further, a winding nip may be formed between the carrier roll and the movable spool, and a line force in the winding nip can be set via the movable spool. In order to compensate for growth in diameter of the reel and in order to set the line force in the winding nip, a common control loop can be used. The method may also include determining the line force in the winding nip via at least one force sensor and regulating the line force by appropriate movement of the spool. Further, when the line forces in the winding nip are less than or equal to 0.5 kN/m, the movable spool can be moved away under control. Moreover, when the line forces in the winding nip are less than or equal to 0.2 kN/m, the movable spool can be moved away under control. Still further, measured variables used for moving the movable spool away under control can be reel diameter and the position of the spool or the reel formed on the spool relative to the carrier drum. The position of the reel can be measured by sensors, and the sensors can be linear variable differential transformers (LVDT). Further still, to set, control and/or regulate the line force in the winding nip, the method can further include monitoring a region of the winding nip with a CCD camera. A respective distance between the carrier drum and the spool or the reel formed on the spool can be registered. Also, the drive assigned to the spool is not changed during the winding operation.

In accordance with another feature of the invention, a mass per unit area of the tissue web in an uncreped state lies in a range from about 11 g/m$^2$ to about 20 g/m$^2$ and in a creped state lies in a range from about 14 g/m$^2$ to about 24 g/m$^2$.

The method can further include forming the web on a crescent former having an inner supporting belt formed by a felt, and guiding the tissue web and felt over at least one evacuated device in a web running direction before a press nip. The evacuated device can be a suction roll. Further, an outer belt of the crescent former, provided in a region of a forming element, may be a mesh belt.

The method may also include pressing the tissue web in a press nip formed between a shoe press having a shoe length in the web running direction greater than or equal to 80 mm. The shoe length can be greater than or equal to 120 mm. Further, the method can include producing a line force in the shoe press that lies in the range from about 60 kN/m to about 90 kN/m. A maximum pressing pressure in the press nip can be less than or equal to 2 bar, and preferably less than or equal to 1.5 bar. The shoe press can include a shoe press unit with a blind-drilled press cover.

The method may further include drying the web on a drying cylinder with reinforcing ribs in the interior. The drying cylinder can be a Yankee cylinder, and the web may be creped from the drying cylinder by a creping doctor having a thickness of less than or equal to 0.9 mm. An angle of attack between a tangent to the drying cylinder and the creping doctor can be less than or equal to 20°, and a rake angle of the creping doctor may be greater than or equal to 15°.

A machine for producing a web of tissue material by supplying at least two stock grades to a multilayer flow box, winding up the tissue web on a reel of a reel-up; and maintaining a winding nip having a line pressure of less than or equal to 0.8 kN/m to influence the hardness of the reel produced, the machine includes a multilayer flow box structured and arranged to supply at least two stock grades, an endless supporting belt, a drying cylinder and an opposing unit arranged to form a press nip, wherein endless supporting belt guides the web through the press nip, a reel-up for reeling up the tissue web, and a device to influence, in a predefined way, a hardness of a reel produced as the tissue web is reeled.

The invention is directed to a machine for producing a web of tissue material, that includes a multilayer flow box structured and arranged to supply at least two stock grades, an endless supporting belt, a drying cylinder and an opposing unit arranged to form a press nip, wherein said endless supporting belt guides the web through said press nip, a reel-up for reeling up the tissue web, and a device to influence, in a predefined way, a hardness of a reel produced as the tissue web is reeled.

According to a feature of the invention, the device to influence is structured and arranged to at least one of control and regulate the hardness of the reel.

Further, the drying cylinder can be a Yankee cylinder. Also, the reel-up can include a winding nip, in which a line force of less than or equal to 0.8 kN/m is produced.

The machine can also include a former having two circulating endless belts, which are arranged to run together to form a stock inlet gap, and a forming element positioned such that the two circulating endless belts are guided over the forming element. An inner belt of the two circulating endless belts that comes into contact with the forming element forms a transport belt. The forming element can be a forming roll.

The machine may also include a crescent former having an inner belt comprising a felt.

Moreover, the machine can have at least one press shoe, such that the supporting belt is arranged to guide the web through the at least one shoe press.

Further, the opposing unit can be a shoe press unit.

In accordance with the invention, a creping doctor is provided, wherein the creping doctor is assigned to the drying cylinder. The creping doctor can be a thin creping doctor.

According to another feature of the invention, a drying hood can be assigned to the drying cylinder, the drying hood being structured and arranged to intensify drying of the tissue web, which is guided over the drying cylinder, in a relevant wrap region of the drying cylinder.

Further, the multiply flow box comprises a nozzle that is subdivided into at least two channels by at least one slat extending over a entire machine width. The nozzle may be subdivided at least substantially symmetrically into two channels by the slat. The slat can extend outwardly beyond the nozzle in a region of an outlet gap.

In accordance with still another feature of the present invention, the multilayer flow box can include at least one of dilution water regulation and section by section control over a machine width. The at least one of dilution water regulation and/or section by section control over the machine width may be provided for each of the at least two layers. Further, the at least one of dilution water regulation and control can be provided at least for a layer facing a forming roll. A proportion of the drying of the tissue web contributed by the drying hood can be greater than a proportion of the drying of the tissue web contributed by the drying cylinder. A ratio between the proportion of the drying from the drying hood and the proportion of the drying from the drying cylinder may be greater than 55:45, can be greater than or equal to 60:40, is preferably greater than or equal to 65:35, and most preferably greater than or equal to 70:30. Further, the drying hood can be operatable at a temperature which may be greater than or equal to 400° C., can be greater than or equal to 500° C., and is preferably greater than or equal to 700° C. A steam pressure in the drying cylinder may be less than or equal to 0.7 MPa, is preferably less than or equal to 0.6 MPa, and most preferably less than or equal to 0.5 MPa.

According to another feature of the instant invention, the reel-up includes a carrier drum, over which the tissue web is guided, and a spool, on which the tissue web is wound, such that a drive is assigned to each of the carrier drum and the spool. The carrier drum and the spool may be arranged to form a winding nip, and a line force produced in the winding nip can be less than or equal to 0.8 kN/m. The line force in the winding nip can be less than or equal to 0.5 kN/m, and is preferably less than or equal to 0.2 kN/m. A maximum difference between a circumferential speed of the reel formed on the spool and a circumferential speed of the carrier drum can be less than 10% of the circumferential speed of the carrier drum. Web tension between the drying cylinder and the carrier drum is at least one of controllable and regulatable to a predefinable desired value via the drive assigned to the carrier drum. The web tension is at least one of controlled and regulated independently of the line force produced in the winding nip. Further, the drive assigned to the spool can be at least one of controllable and regulatable as a function of a speed of the carrier drum. The carrier drum may be mounted in a fixed position and the spool is movably mounted. Moreover, a device to automatically compensate for the growth in a winding diameter by appropriately moving the spool can be provided. The machine may also include a device to automatically set a line force in the winding nip via the movable spool. Also, a common control loop structured and arranged to compensate for growth in a winding diameter and to set a line force in the winding nip can be included.

According to still another feature of the present invention, at least one force sensor can be structured and arranged to determine a line force in the winding nip, wherein a line force is regulatable by appropriately moving the spool. When the line forces in the winding nip are less than or equal to 0.5 kN/m, the spool can be moved away from the carrier roll under control. When the line forces are less than or equal to 0.2 kN/m, the spool may be moved away from the carrier roll under control. Further, variables for moving the spool under control are winding diameter and position of the spool or the reel formed on the spool relative to the carrier drum. Sensors to measure the position of the reel can be included, and the sensors can include linear variable differential transformers. Still further, a CCD camera may be structured and arranged to monitory a region of the winding nip in order to at least one of set, control and regulate the line force in the winding nip. The CCD camera can be arranged to register respective distances between the carrier drum and the spool or the reel formed on the spool.

According to the invention, the may also include a crescent former and at least one evacuated device, wherein the supporting belt can be an inner belt of the crescent formed by a felt, and the inner belt may guide the tissue web over the at least one evacuated device in a web running direction before the press nip. The at least one evacuated device can be a suction roll. The crescent former can be a forming element, and an outer belt, provided in a region of the forming element, may be formed by a mesh belt.

The press nip may include a shoe press having a shoe length measured in a web running direction which is greater than or equal to 80 mm, and preferably greater than or equal to 120 mm. A line force produced by the shoe press can lie in a range from about 60 kN/m to about 90 kN/m. further, a maximum pressing pressure in the press nip of the shoe press can be less than or equal to 2 bar, and preferably less than or equal to 1.5 bar. The shoe press can include a shoe press unit with a blind-drilled press cover.

In accordance with still yet another feature of the present invention, the drying cylinder can include reinforcing ribs in an interior. A thickness of the creping doctor may be less than or equal to 0.9 mm. Further, an angle of attack between a tangent to the drying cylinder and the creping doctor may be less than or equal to 20°, and a rake angle of the creping doctor can be is greater than or equal to 15°.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
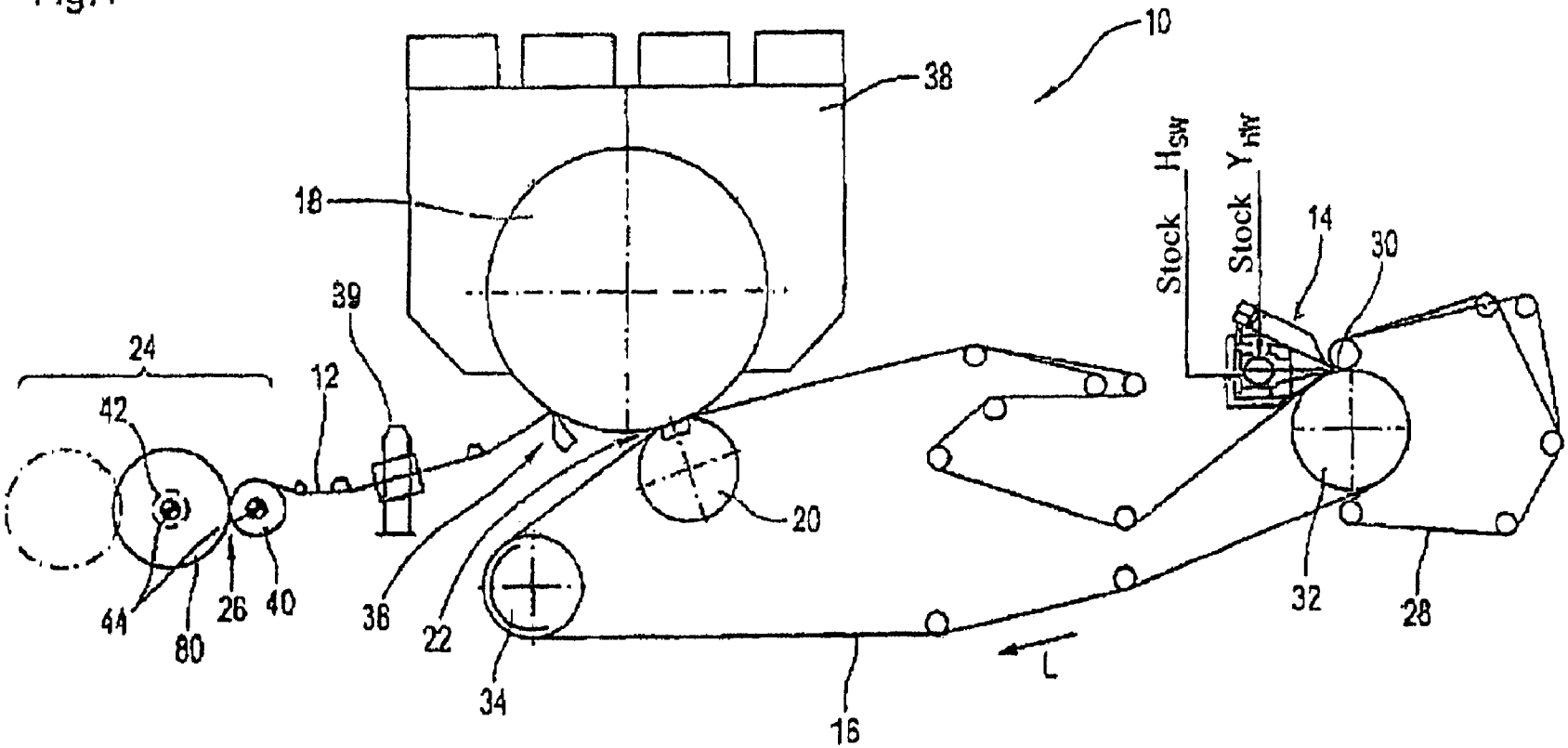
FIG. 1 schematically illustrates an exemplary embodiment of the tissue machine according to the invention.

FIG. 1 shows, in a schematic illustration, an exemplary embodiment of a machine 10 according to the invention for the production of a tissue web 12.

The tissue machine 10 comprises a flow box 14 and an endless supporting belt 16, with which the tissue web 12 is led through a press nip 22 formed between a drying cylinder 18, here a Yankee cylinder 18, and an opposing unit 20.

The tissue machine 10 also comprises a reel-up 24 for subsequently reeling up the tissue web 12.

The flow box 14 provided is a multilayer flow box, in the present case a two-layer flow box, to which at least two different stock grades can be supplied.

Furthermore, a device described in more detail further below is provided in order to influence the hardness of the reel produced in a predefinable manner when reeling up the tissue web 12, that is to say in particular to control and/or regulate it. In this case, the line force produced in the winding nip 26 is preferably kept below or equal to 0.8 kN/m. A former having two circulating endless belts 16, 28 is provided, one of these two endless circulating belts 16, 28 simultaneously forming the transport belt 16.

As can be seen by using FIG. 1, the two endless belts 16, 28 run together, forming a stock inlet gap 30, in order then to be led over a forming element 32, in particular a forming or breast roll. In this case, the wrap angle with respect to the outer belt 28 is smaller than that with respect to the inner supporting belt 16.

In the present case, a crescent former is provided, whose inner belt (supporting belt) 16 is formed by a felt.

Into the inlet gap 30 formed between the supporting belt 16 and the outer wire 28, by the multilayer flow box 14, different stock grades, in the present case a stock grade HW of fibers made from hardwood and a stock grade SW of fibers made from softwood, are introduced. The fibers made of hardwood can be, in particular, short fibered chemical pulps, and the fibers made of softwood can be, in particular, long-fibered chemical pulps.

After the wrap region of the forming roll 32, the tissue web forming in the process, together with the supporting belt 16, is supplied to the press nip 22, which is extended in the web running direction L.

Before reaching the extended press nip 22, the supporting belt 16 carrying the tissue web 12 with it wraps around an evacuated device, designed here as a suction roll 34. The suction roll 34 removes a substantial part of the water from the supporting belt 16 and even somewhat from the outer tissue web 12.

The opposing unit 20 assigned to the drying cylinder 18 is formed in the present case by a shoe press unit, in particular a shoe press roll. The press nip 22 is therefore the extended press nip of a shoe press comprising the drying cylinder 18 and shoe press unit 20.

A creping doctor or bar, in particular a thin creping doctor or bar 36, is assigned to the drying cylinder 18.

Following the press nip 22, the tissue web 12 is led around the drying cylinder 18. In this case, a drying hood 38 is provided in order to intensify the drying in the relevant wrap region.

As can be seen by using FIG. 1, a measuring frame 39 is provided between the drying cylinder 18 and the reel-up 24. In this case, the measured values obtained can, for example, also be used for cross-machine profile regulation of specific web properties.

In the reel-up 24, the tissue web 12 is first led over a carrier drum 40 and then wound on to a spool 42. In this case, preferably both the carrier drum 40 and the spool 42 are each assigned a separate drive 44.

As can be seen by using FIG. 1, the stock grade HW made of short fibers obtained from hardwood is used for the layer Y facing the surface of the drying cylinder 18, and the stock grade made of long fibers obtained from softwood is used for the layer provided on the opposite web side.

Figure 2:
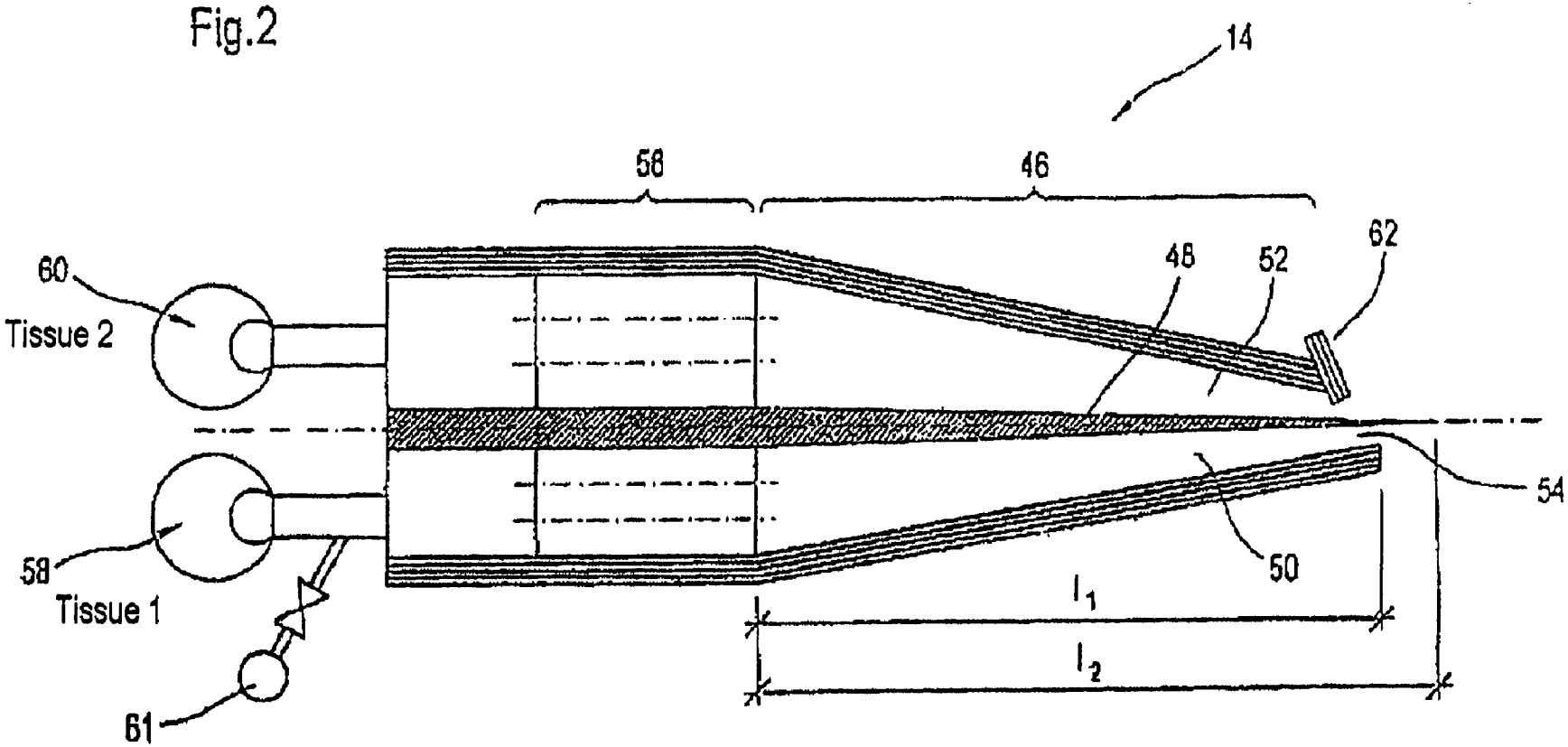
FIG. 2 schematically illustrates an exemplary embodiment of the flow box of the tissue machine according to the invention.

FIG. 2 shows, in a schematic illustration, an exemplary embodiment of the flow box 14 of the tissue machine according to the invention. In this case, the nozzle 46 of this flow box 14 is at least substantially divided into two channels 50, 52 by a slat 48 extending over the entire machine width. The slat 48 extends outward beyond the nozzle 46 in the region of the outlet gap 54. The slat length $l_2$ measured starting from the turbulence generator 56 of the flow box 14, just like the nozzle length $l_1$, is therefore greater than the nozzle length $l_1$.

Furthermore, the cross-machine distributor pipes 58, 60 for the two stock grades can be seen in FIG. 2.

In the present case, moreover, dilution water regulation and/or control section by section is provided over the machine width only for the layer facing the forming roll 32 (cf. FIG. 1). In FIG. 2, a cross-machine distribution pipe 61 for dilution water, for example, can be seen.

In the region of the outlet gap 54 of the nozzle 46, one or more slices 62 can be provided. However, such slices are not imperative.

The proportion of the drying contributed by the drying hood 38 to the drying of the tissue web 12 is preferably greater than the proportion of the drying contributed by the drying cylinder 18.

Figure 3:
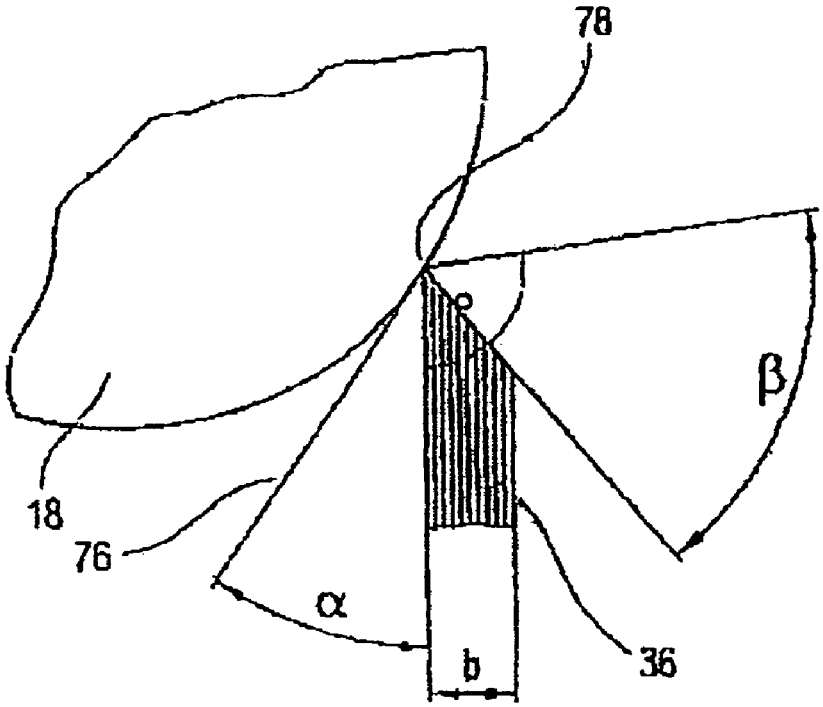
FIG. 3 schematically illustrates a part of a creping doctor assigned to the drying cylinder of the tissue machine according to the invention.

FIG. 3 shows, in a schematic partial illustration, a creping doctor 36 assigned to the drying cylinder or Yankee cylinder 18 of the tissue machine 10 according to the invention (cf. FIG. 1).

In the present exemplary embodiment, illustrated in FIG. 3, the thickness b of the creping doctor 36 is less than or equal to 0.9 mm. The angle of attack or clearance angle $\alpha$ between the tangent 76 to the drying cylinder 18 passing through the point of contact 78 and the creping doctor 36 is less than or equal to 20°. The "rake angle" of the creping doctor 36, designated "$\beta$" in FIG. 3, can in particular be greater than or equal to 15°.

Figure 4:
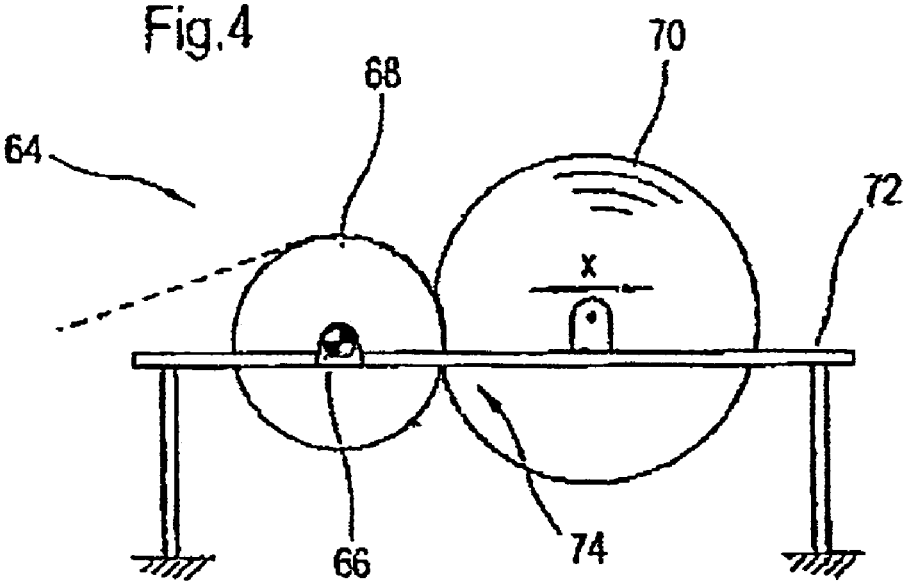
FIG. 4 schematically illustrates a conventional reel-up for tissue.

FIG. 4 shows, in a schematic illustration, a conventional reel-up 64 for tissue, in which the carrier drum 68 provided with a drive 66 is pressed against the reel 70 onto which the tissue web produced is wound up, as a result of which the reel 70 is driven. The carrier drum 68 is fixed in position. The reel 70 can be moved on rails 72. The pressing force must be sufficiently high for the necessary drive power to be transmitted. The line force produced in the winding nip 74 is around 0.8 kN/m (width). The line force here is so high that the carrier drum 68 dips into the soft reel 70 and thus destroys or reduces the specific volume (bulk). The growth in the diameter of the reel 70 is taken into account by moving the reel 70 away from the carrier drum 68.

Figure 5:
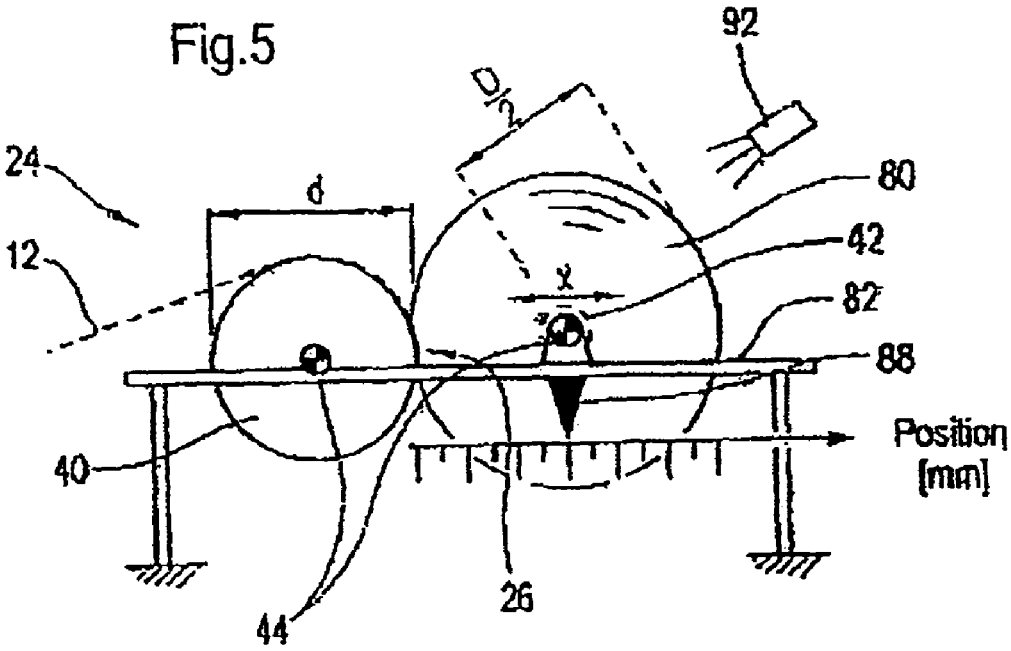
FIG. 5 schematically illustrates an exemplary embodiment of a reel-up according to the invention, having a spool or reel that can be moved away under control.
Figure 6:
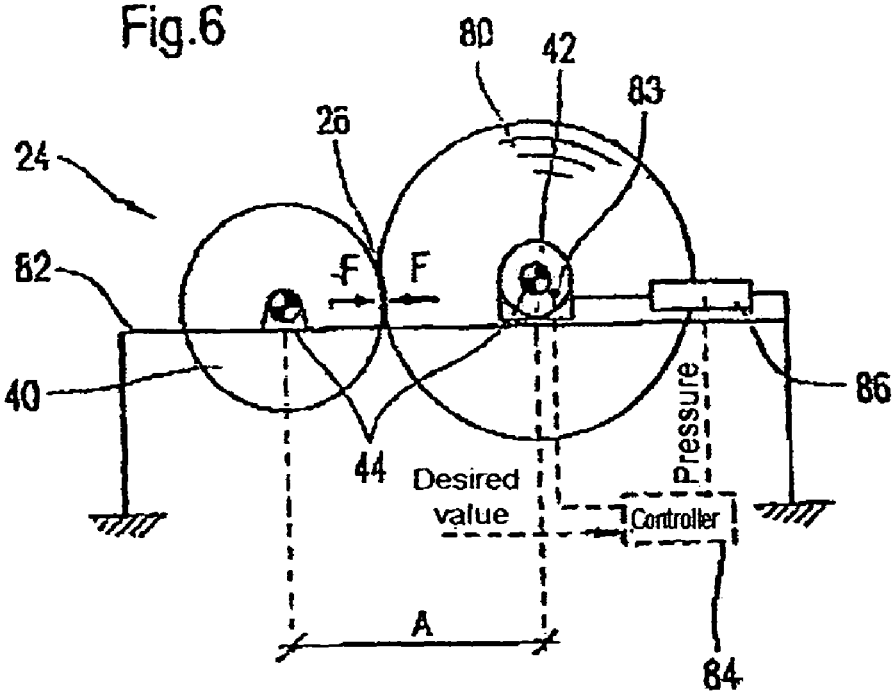
FIG. 6 schematically illustrates a further embodiment of the reel-up according to the invention belonging to the tissue machine according to the invention, having a movable spool or reel with associated pressure and/or force sensors.

FIGS. 5 and 6 show, in a schematic illustration, two exemplary embodiments of the reel-up 24 according to the invention.

In the respective reel-up 24, the tissue web 12 is led over a carrier drum 40 and then wound up onto a spool 42. In both the exemplary embodiments, both the carrier drum 40 and the spool 42 are each assigned a drive 44.

Between the reel 80 forming on the spool 42 and the carrier drum 40, a winding nip or contact nip 26 is formed, in which a line force is produced which critically influences the resultant winding hardness. At least the spool 42 can be moved in the x direction, that is to say for example horizontally, along rails 82 or the like.

The embodiment shown in FIG. 6 of the reel-up 24 is an example of a possible solution for the regulation of the line force.

In the present case, the carrier drum 40 is mounted in a fixed position on the rails 82. By contrast, the spool 42 and, in a corresponding way, the reel 80 formed on the latter can be moved. In this case, the spool 42 can have its position changed, for example by translational actuators provided on both sides, such as threaded rods with associated motor, hydraulic cylinders and so on.

Preferred criteria for the displacement of the spool 42 and the reel 80 formed on the latter are the growth in the winding diameter D and the line force in the winding nip 26.

In this embodiment, both criteria can be satisfied by a control loop.

Sensors 83 which measure the nip force F in the region of the press nip 26 directly or indirectly can be integrated in the bearings of the spool 42. The aforementioned sensors can be, for example, pressure sensors, force sensors, strain gages and so on.

For instance, if the measured force differs from the predefined force, that is to say an appropriate desired value, then the pressure of a relevant hydraulic cylinder, for example, is changed by a controller 84, for example via a hydraulic unit, in such a way that the difference between the desired value and the measured value becomes zero.

Of course, a modification of this embodiment in which only the carrier drum 40 or both the carrier drum 40 and the spool 42 can be moved or displaced is also conceivable. In the case of a movable carrier drum 40, the latter has the relevant sensors via which the nip force F is regulated.

The reel displacement in this case only compensates for the growth in the reel diameter D.

The distance between the axes of the carrier drum 40 and of the spool 42 or of the reel 80, which is increasingly enlarged during the winding operation, is designated "A" in FIG. 6.

In the case of lower line forces and large, heavy reels, it is possible for the case to occur in which the measurement accuracy of the sensors and the setting accuracy (friction) are no longer adequate.

In particular in the case of line forces in the winding nip 26 which are less than or equal to 0.5 kN/m and in particular less than or equal to 0.2 kN/m, for example the movable spool and, in a corresponding way, the reel 80 formed on the latter are preferably designed such that they can be moved away under control. The embodiment shown in FIG. 5 concerns a corresponding design.

The measured variables provided for this away movement under control are, in particular, the following variables:

diameter D of the reel 80 position of the reel 80 or of the spool 42 relative to the carrier drum 40.

In this case, the position of the reel 80 can be measured, for example, by sensors such as LVDTs (linear variable differential transformers), and the diameter of the reel can be determined by a distance sensor, for example optically or acoustically. The actuators 86 (cf. FIG. 6), which can be hydraulic cylinders and so on, for example, position the reel 80 accurately such that the latter just touches the carrier drum 40, for example. In this case, the line force $F_L$ produced in the winding nip 26 is therefore equal to zero. If $F_L>0$ kN/m is to be the case, then the reel 80 can be moved further onto the carrier drum 40 by a predefined distance which, in particular, depends on the softness of the reel 80. Therefore, a slight desired pressure in the press nip or contact nip 26 of, for example, $F_L \leqq 0.2$ kN/m is produced. The distance A (cf. also FIG. 6) is therefore $A<d/2+D/2$ or $A=d/2+D/2-x$, where "x" is the measure of how far the carrier drum 40 dips into the reel 80 formed on the spool 42.

A further possible way of monitoring and setting the nip force results, for example, from the observation of the nip region with a CCD camera. Using the latter, in particular the distance between the carrier drum 40 and the reel 80 can be measured and displayed. By using an appropriate evaluation of the image obtained, a desired value, for example for a hydraulic cylinder pressure, can again be calculated and, via a control device, can effect the displacement as far as the desired distance or nip force. The bulk gain lies in a range from 4 to 8%.

In order to illustrate the outward movement control, in the illustration according to FIG. 5 the spool 42 is assigned a pointer 88, whose position with respect to a stationary scale 90 ultimately indicates the position of the spool 42 and therefore of the reel 80 formed on the latter.

Furthermore, in FIG. 5 it is possible to see a sensor 92, which can in particular be a sensor of the aforementioned type, for example only a CCD camera or the like.

Figure 7:
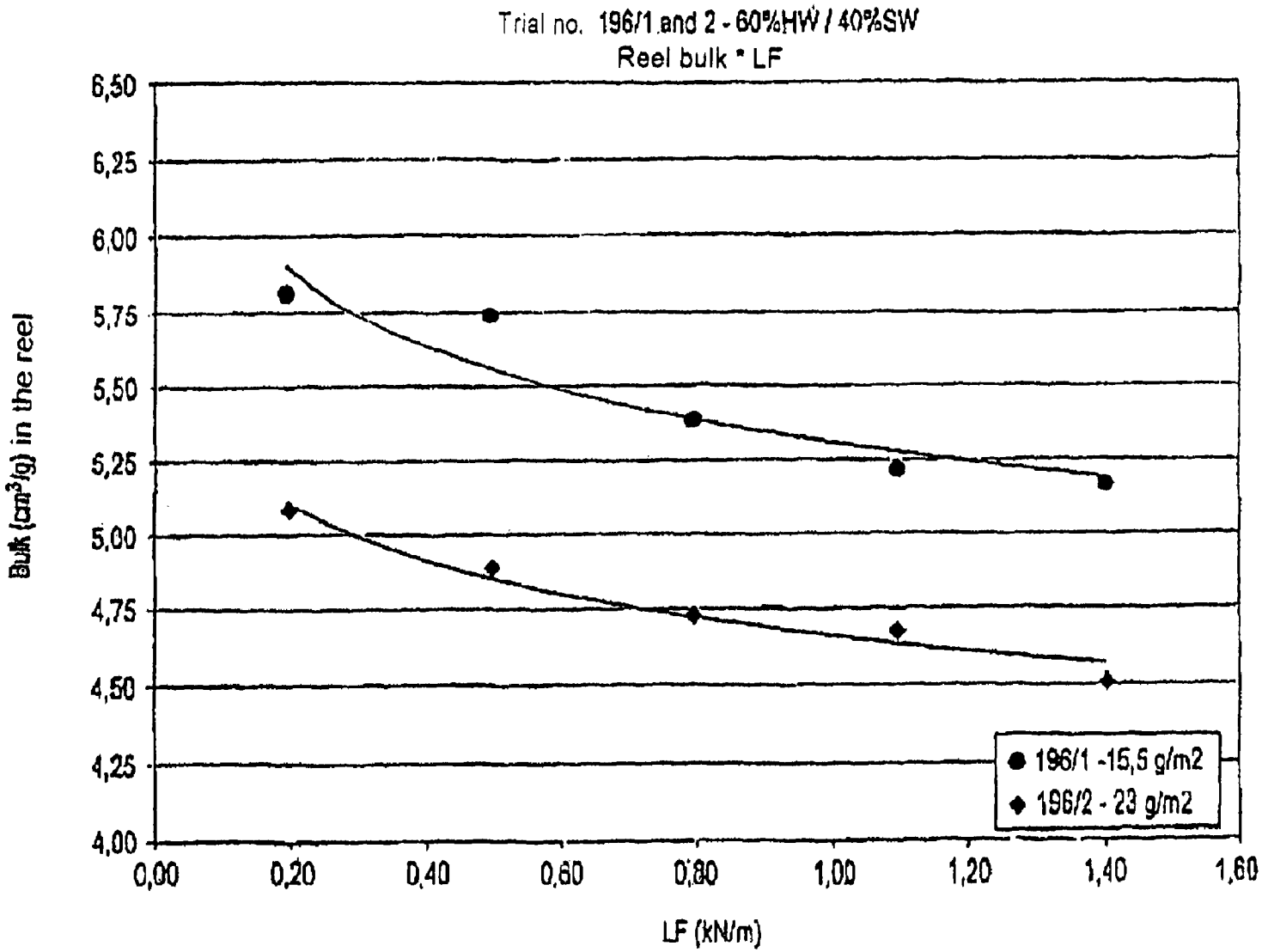
FIG. 7 illustrates a graph which reproduces the influence of the line force in the winding nip on the specific volume (bulk) of the tissue web in the reel.

FIG. 7 shows a graph which reproduces the influence of the line force $L_F$ in the winding nip on the specific volume (bulk) of the tissue web in the reel. "HW" designates a stock grade of fibers made from hardwood and "SW" designates a stock grade of fibers made from softwood.

Figure 8:
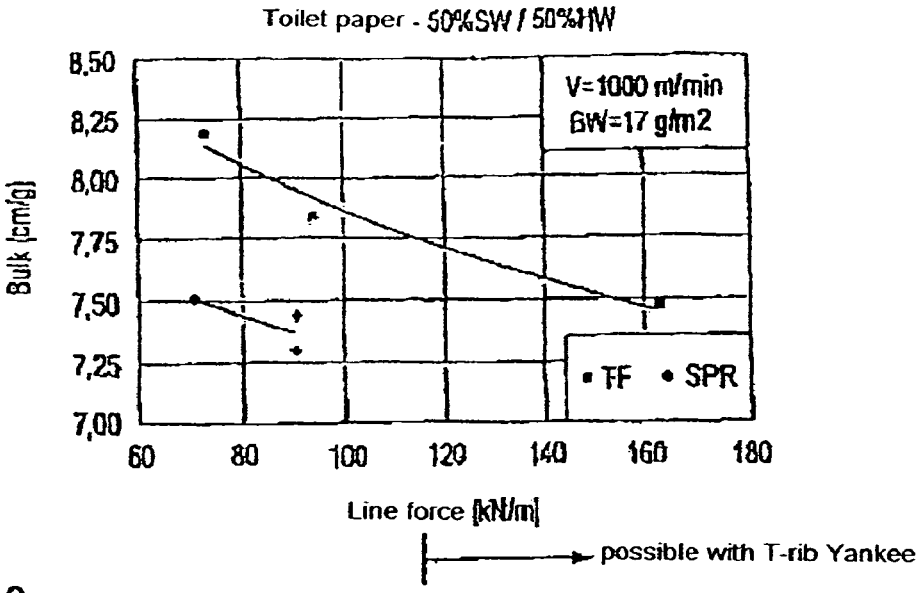
FIG. 8 illustrates a graph which, as compared with a suction press roll (SPR), reproduces the influence of a shoe press (TF) provided in accordance with the invention on the specific volume (bulk) as a function of the line force of the press, what is known as a "T-rib" Yankee cylinder, i.e., a Yankee cylinder provided with internal reinforcing ribs, being used above 90 kN/m.

FIG. 8 shows a graph which, in comparison with a suction press roll (SPR), reproduces the influence of a shoe press (TF) provided in accordance with the invention on the specific volume (bulk) as a function of the line force of the press. In this case, beginning at 90 kN/m, what is known as a "T-rib" Yankee cylinder, that is to say a Yankee cylinder provided with internal reinforcing ribs, is used.

Figure 9:
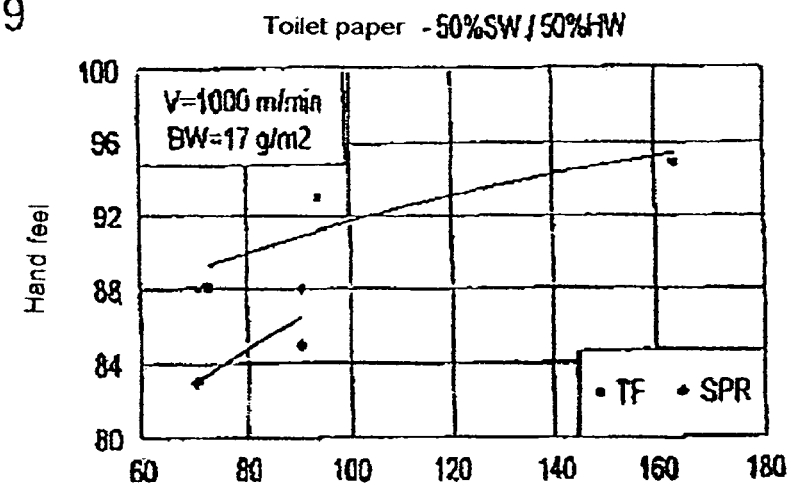
FIG. 9 illustrates graph, comparable with the graph of FIG. 8, but in this case for the "hand feel"

FIG. 9 shows a graph that is comparable with the graph of FIG. 8, but in this case for the "hand feel" already mentioned at the beginning.

Figure 10:
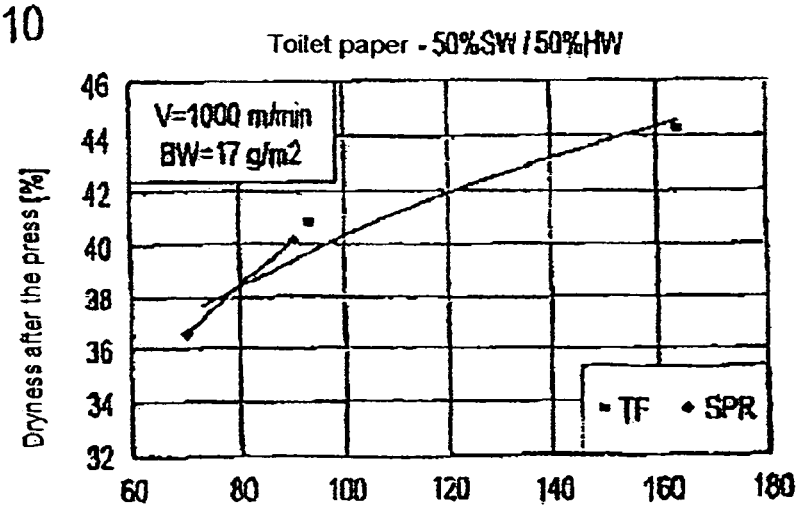
FIG. 10 illustrates a graph, comparable with the graph of FIG. 8, but in this case for the dryness after the press.

In addition, FIG. 10 again shows a graph that is comparable with the graph of FIG. 8, but in this case for the dryness after the press.

Figure 11:
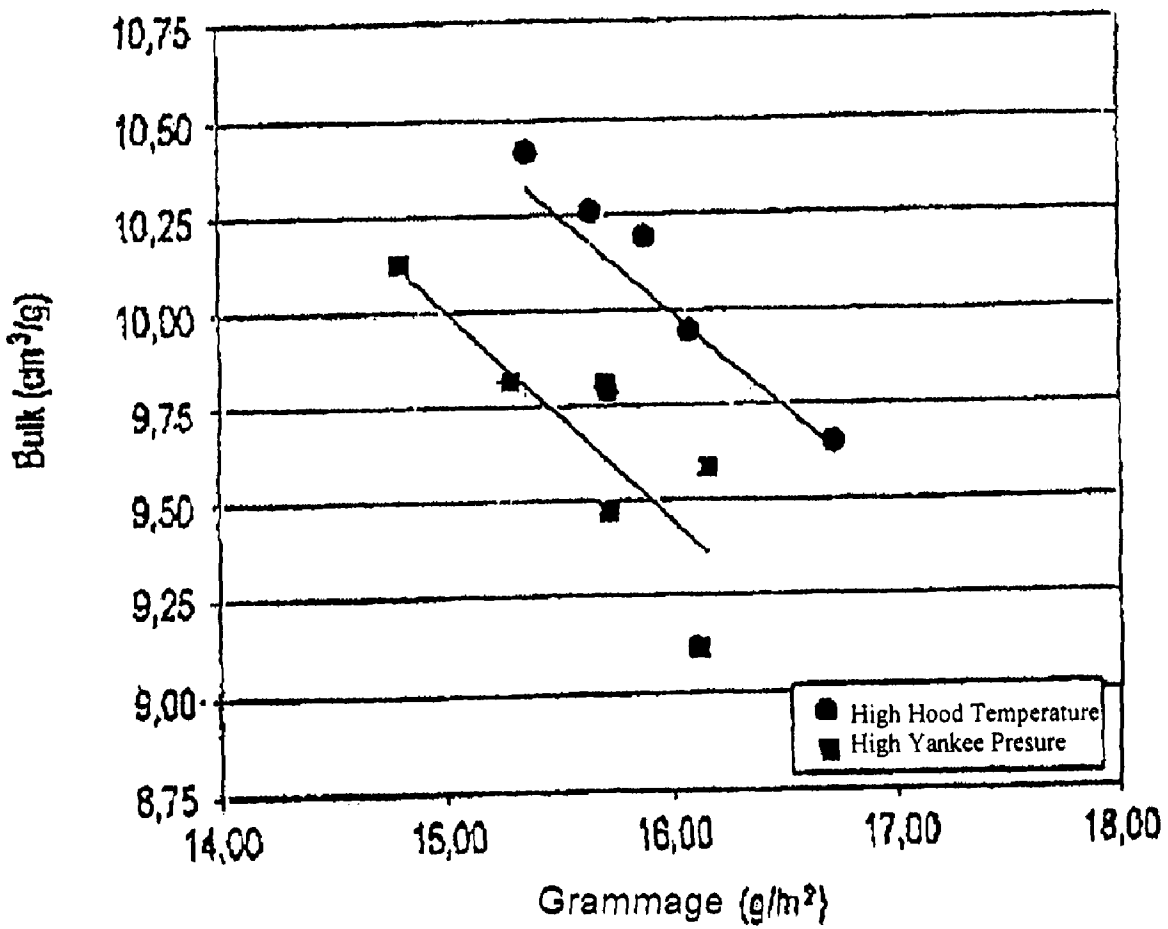
FIG. 11 illustrates a graph which reproduces the influence of drying conditions such as, in particular, the drying ratio between Yankee cylinder/drying hood.

The graph of FIG. 11 reproduces the influence of drying conditions, such as in particular the drying ratio Yankee cylinder/drying hood.

Figure 12:
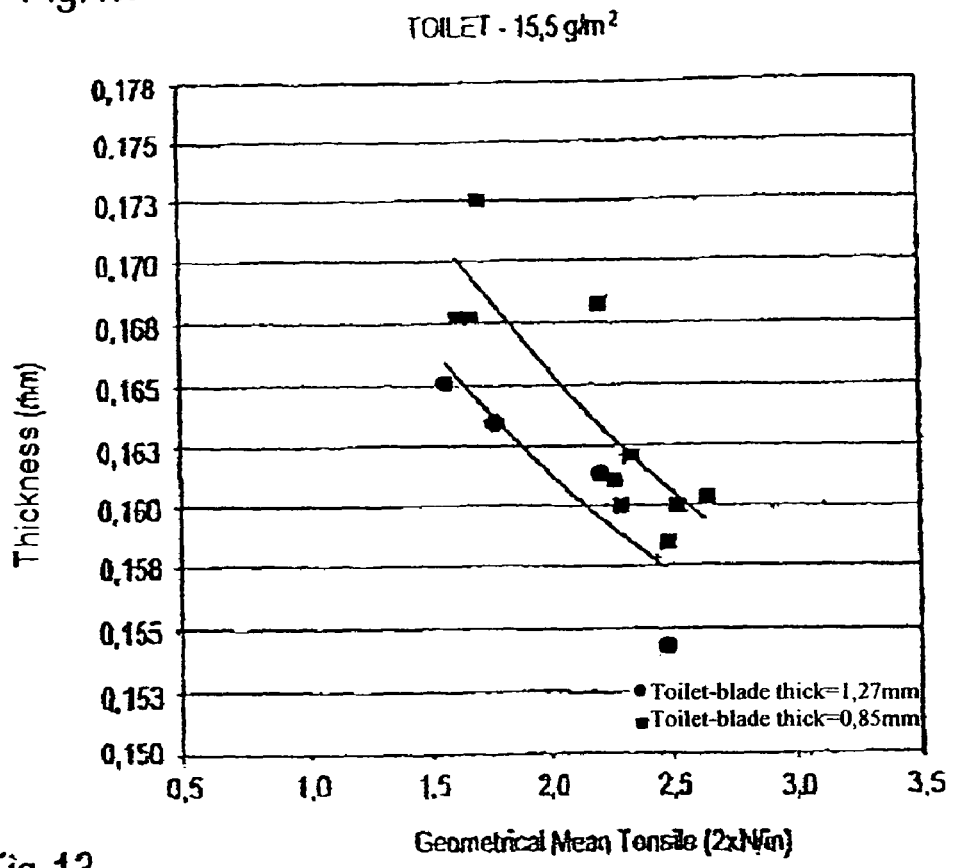
FIG. 12 illustrates a graph which reproduces the influence of the thickness of the creping doctor on the thickness of the tissue paper (bulk)

The graph of FIG. 12 shows the influence of the thickness of the creping doctor on the thickness of the tissue paper, which here corresponds to the specific volume (bulk). On the other hand, an improved "hand feel" value is also possible at a constant "bulk" value. In the graph, the abbreviation "GMT" stands for the expression "geometric mean tensile strength".

Figure 13:
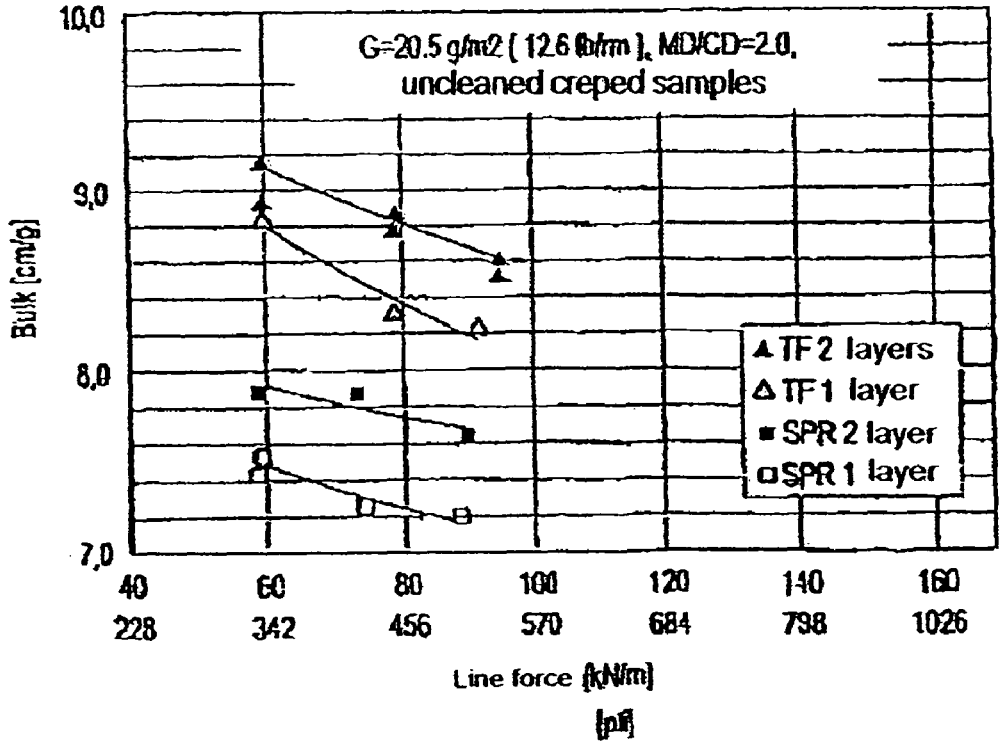
FIG. 13 illustrates a graph which reproduces the influence of the multilayer production of the tissue paper on the specific volume (bulk) in different presses, it being possible in particular to see the advantage resulting from the use of a shoe press (TF) as compared with a suction press roll (SPR).

FIG. 13 shows a graph which reproduces the influence of the multilayer production of the tissue paper on the specific volume (bulk) in the case of different presses, it being possible to see in particular the advantage resulting from the use of a shoe press (TF) as compared with a suction press roll (SPR).

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF DESIGNATIONS

10 Tissue machine
12 Tissue web
14 Flow box
16 Endless circulating belt, supporting belt
18 Drying cylinder, Yankee cylinder
20 Opposing unit, shoe press unit
22 Press nip, contact nip
24 Reel-up
26 Winding nip
28 Endless circulating belt, outer wire
30 Stock inlet gap
32 Forming element, forming roll, breast roll
34 Evacuated device, suction roll
36 Creping doctor, doctor bar
38 Drying hood
39 Measuring frame
40 Carrier drum
42 Spool
44 Drive
46 Nozzle
48 Slat
50 Channel
52 Channel
54 Outlet gap
56 Turbulence generator
58 Cross-machine distribution pipe
60 Cross-machine distribution pipe
61 Cross-machine distribution pipe
62 Slice
64 Reel-up
66 Drive
68 Carrier drum
70 Reel
72 Rails
74 Winding nip
76 Tangent
78 Point of contact
80 Reel
82 Rails
83 Sensor
84 Controller
86 Actuator
88 Pointer
90 Scale
92 Sensor
A Distance
D Reel diameter
F Nip force, force in the winding nip
b Thickness
$l_1$ Nozzle length
$l_2$ Slat length
$\alpha$ Angle of attack, clearance angle
$\beta$ "Rake angle"

What is claimed is:

1. A machine for producing a web of tissue material by supplying at least two stock grades to a multilayer flow box, winding up the tissue web on a reel of a reel-up; and maintaining a winding nip having a line pressure of less than or equal to 0.8 kN/m to influence the hardness of the reel produced, the machine comprising:

a multilayer flow box structured and arranged to supply at least two stock grades;

an endless supporting belt;

a drying cylinder and an opposing unit arranged to form a press nip, wherein endless supporting belt guides the web through the press nip;

a reel-up for reeling up the tissue web; and a device to influence, in a predefined way, a hardness of a reel produced as the tissue web is reeled, comprising a controller to maintain in the winding nip the line pressure of less than or equal to 0.8 kN/m, wherein said multilayer flow box comprises a nozzle that is subdivided into at least two channels by at least one slat extending over a entire machine width, and wherein said slat extends outwardly beyond said nozzle in a region of an outlet gap.

2. A machine for producing a web of tissue material, comprising:

a multilayer flow box structured and arranged to supply at least two stock grades;

an endless supporting belt;

a drying cylinder and an opposing unit arranged to form a press nip, wherein said endless supporting belt guides the web through said press nip;

a reel-up for reeling up the tissue web; and a device to influence, in a predefined way, a hardness of a reel produced as the tissue web is reeled, comprising a controller to maintain in the winding nip the line pressure of less than or equal to 0.8 kN/m, wherein said multilayer flow box comprises a nozzle that is subdivided into at least two channels by at least one slat extending over a entire machine width, and wherein said slat extends outwardly beyond said nozzle in a region of an outlet gap.

3. The machine in accordance with claim 2, wherein said device to influence is structured and arranged to at least one of control and regulate the hardness of the reel.

4. The machine in accordance with claim 2, wherein said drying cylinder comprises a Yankee cylinder.

5. The machine in accordance with claim 2, wherein said reel-up comprises a winding nip, in which a line force of less than or equal to 0.8 kN/m is produced.

6. The machine in accordance with claim 2, further comprising:

a former having two circulating endless belts, which are arranged to run together to form a stock inlet gap;

a forming element positioned such that said two circulating endless belts are guided over said forming element.

7. The machine in accordance with claim 6, wherein an inner belt of said two circulating endless belts that comes into contact with said forming element forms a transport belt.

8. The machine in accordance with claim 6, wherein said forming element comprises a forming roll.

9. The machine in accordance with claim 2, further comprising a crescent former having an inner belt comprising a felt.

10. The machine in accordance with claim 2, further comprising at least one press shoe, wherein the supporting belt is arranged to guide the web through said at least one shoe press.

11. The machine in accordance with claim 2, wherein said opposing unit comprises a shoe press unit.

12. The machine in accordance with claim 2, further comprising a creping doctor, wherein said creping doctor is assigned to said drying cylinder.

13. The machine in accordance with claim 12, wherein said creping doctor is a thin creping doctor.

14. The machine in accordance with claim 12, wherein a thickness of said creping doctor is less than or equal to 0.9 mm.

15. The machine in accordance with claim 12, wherein an angle of attack between a tangent to said drying cylinder and said creping doctor is less than or equal to 20°.

16. The machine in accordance with claim 12, wherein a rake angle of said creping doctor is greater than or equal to 15°.

17. The machine in accordance with claim 2, further comprising a drying hood assigned to said drying cylinder, said drying hood being structured and arranged to intensify drying of the tissue web, which is guided over said drying cylinder, in a relevant wrap region of said drying cylinder.

18. The machine in accordance with claim 17, wherein a proportion of the drying of the tissue web contributed by said drying hood is greater than a proportion of the drying of the tissue web contributed by said drying cylinder.

19. The machine in accordance with claim 18, wherein a ratio between the proportion of the drying from said drying hood and the proportion of the drying from said drying cylinder is greater than 55:45.

20. The machine in accordance with claim 19, wherein the ratio is greater than or equal to 60:40.

21. The machine in accordance with claim 19, wherein the ratio is greater than or equal to 65:35.

22. The machine in accordance with claim 19, wherein the ratio is greater than or equal to 70:30.

23. The machine in accordance with claim 17, wherein said drying hood is operatable at a temperature which is greater than or equal to 400° C.

24. The machine in accordance with claim 23, wherein said drying hood is operable at a temperature greater than or equal to 500° C.

25. The machine in accordance with claim 23, wherein said drying hood is operable at a temperature greater than or equal to 700° C.

26. The machine in accordance with claim 2, wherein said nozzle is subdivided at least substantially symmetrically into two channels by said slat.

27. The machine in accordance with claim 2, wherein said multilayer flow box comprises at least one of dilution water regulation and section by section control over a machine width.

28. The machine in accordance with claim 27, wherein said at least one of dilution water regulation and/or section by section control over the machine width is provided for each of the at least two layers.

29. The machine in accordance with claim 27, wherein said at least one of dilution water regulation and control is provided at least for a layer facing a forming roll.

30. The machine in accordance with claim 2, wherein a steam pressure in said drying cylinder is less than or equal to 0.7 MPa.

31. The machine in accordance with claim 30, wherein the steam pressure is less than or equal to 0.6 MPa.

32. The machine in accordance with claim 30, wherein the steam pressure is less than or equal to 0.5 MPa.

33. The machine in accordance with claim 2, said reel-up comprises a carrier drum, over which the tissue web is guided, and a spool, on which the tissue web is wound, wherein a drive is assigned to each of said carrier drum and said spool.

34. The machine in accordance with claim 33, wherein said carrier drum and said spool are arranged to form a winding nip, and a line force produced in the winding nip is less than or equal to 0.8 kN/m.

35. The machine in accordance with claim 34, wherein the line force in the winding nip is less than or equal to 0.5 kN/m.

36. The machine in accordance with claim 34, wherein the line force in the winding nip is less than or equal to 0.2 kN/m.

37. The machine in accordance with claim 33, wherein a maximum difference between a circumferential speed of the reel formed on said spool and a circumferential speed of said carrier drum is less than 10% of the circumferential speed of the carrier drum.

38. The machine in accordance with claim 33, wherein web tension between said drying cylinder and said carrier drum is at least one of controllable and regulatable to a predefinable desired value via said drive assigned to said carrier drum.

39. The machine in accordance with claim 38, wherein the web tension is at least one of controlled and regulated independently of the line force produced in the winding nip.

40. The machine in accordance with claim 33, wherein said drive assigned to said spool is at least one of controllable and regulatable as a function of a speed of said carrier drum.

41. The machine in accordance with claim 33, wherein said carrier drum is mounted in a fixed position and said spool is movably mounted.

42. The machine in accordance with claim 33, further comprising a device to automatically compensate for the growth in a winding diameter by appropriately moving said spool.

43. The machine in accordance with claim 33, further comprising a device to automatically set a line force in said winding nip via said movable spool.

44. The machine in accordance with claim 33, further comprising a common control loop structured and arranged to compensate for growth in a winding diameter and to set a line force in said winding nip.

45. The machine in accordance with claim 33, wherein variables for moving said spool under control are winding diameter and position of said spool or the reel formed on said spool relative to said carrier drum.

46. The machine in accordance with claim 45, further comprising sensors to measure the position of said reel.

47. The machine in accordance with claim 46, wherein said sensors comprise linear variable differential transformers.

48. The machine in accordance with claim 33, further comprising a CCD camera structured and arranged to monitory a region of said winding nip in order to at least one of set, control and regulate the line force in said winding nip.

49. The machine in accordance with claim 48, wherein said CCD camera is arranged to register respective distances between said carrier drum and said spool or said reel formed on said spool.

50. The machine in accordance with claim 2, further comprising at least one force sensor structured and arranged to determine a line force in said winding nip, wherein a line force is regulatable by appropriately moving said spool.

51. The machine in accordance with claim 50, wherein, when the line forces in said winding nip are less than or equal to 0.5 kN/m, said spool is moved away from said carrier roll under control.

52. The machine in accordance with claim 50, wherein, when the line forces are less than or equal to 0.2 kN/m, said spool is moved away from said carrier roll under control.

53. The machine in accordance with claim 2, further comprising:

a crescent former; and at least one evacuated device, wherein said supporting belt is an inner belt of said crescent formed by a felt, and said inner belt guides the tissue web over said at least one evacuated device in a web running direction before said press nip.

54. The machine in accordance with claim 53, wherein said at least one evacuated device comprises a suction roll.

55. The machine in accordance with claim 53, wherein said crescent former comprises a forming element, and an outer belt, provided in a region of said forming element, is formed by a mesh belt.

56. The machine in accordance with claim 2, wherein said press nip comprises a shoe press having a shoe length measured in a web running direction which is greater than or equal to 80 mm.

57. The machine in accordance with claim 56, wherein the shoe length is greater than or equal to 120 mm.

58. The machine in accordance with claim 57, wherein a line force produced by said shoe press lies in a range from about 60 kN/m to about 90 kN/m.

59. The machine in accordance with claim 57, wherein a maximum pressing pressure in said press nip of said shoe press is less than or equal to 2 bar.

60. The machine in accordance with claim 59, wherein the maximum pressing pressure is less than or equal to 1.5 bar.

61. The machine in accordance with claim 57, wherein said shoe press comprises a shoe press unit with a blind-drilled press cover.

62. The machine in accordance with claim 2, wherein said drying cylinder includes reinforcing ribs in an interior.

* * * * *